US010477982B2

(12) United States Patent
Damiani

(10) Patent No.: US 10,477,982 B2
(45) Date of Patent: Nov. 19, 2019

(54) BABY CRIB

(71) Applicant: Artsana S.p.A., Grandate (IT)

(72) Inventor: Osvaldo Damiani, Curno (IT)

(73) Assignee: Artsana S.P.A. (IT)

( * ) Notice: Subject to any disclaimer, the term of this patent is extended or adjusted under 35 U.S.C. 154(b) by 274 days.

(21) Appl. No.: 15/435,780

(22) Filed: Feb. 17, 2017

(65) Prior Publication Data

US 2017/0238721 A1 Aug. 24, 2017

(30) Foreign Application Priority Data

Feb. 19, 2016 (EP) ..... 16156569

(51) Int. Cl.
*A47D 9/00* (2006.01)
*A47D 7/02* (2006.01)
*A47D 15/00* (2006.01)

(52) U.S. Cl.
CPC ..... *A47D 9/005* (2013.01); *A47D 7/02* (2013.01); *A47D 15/001* (2013.01); *A47D 15/008* (2013.01)

(58) Field of Classification Search
CPC ..... A47D 9/005; A47D 7/02; A47D 15/001; A47D 15/008; A47D 9/00–04
See application file for complete search history.

(56) References Cited

U.S. PATENT DOCUMENTS

| | | | | |
|---|---|---|---|---|
| 3,921,233 | A | 11/1975 | Mann | |
| 9,962,012 | B1 * | 5/2018 | Schmid | A47D 9/00 |
| 2002/0002741 | A1 * | 1/2002 | Tomas | A47D 9/00 5/101 |
| 2010/0229300 | A1 * | 9/2010 | Eirich | A47D 9/00 5/93.1 |
| 2011/0308011 | A1 * | 12/2011 | Cheng | A47D 7/04 5/93.1 |
| 2016/0106226 | A1 * | 4/2016 | Yi | A47D 9/00 5/11 |
| 2016/0286979 | A1 * | 10/2016 | Sclare | A47D 9/00 |

FOREIGN PATENT DOCUMENTS

| | | | |
|---|---|---|---|
| NL | 1015897 | C1 | 2/2002 |
| WO | 2007086066 | A1 | 8/2007 |

OTHER PUBLICATIONS

European Search Report for EP16156569.2 dated Jun. 3, 2016.

* cited by examiner

*Primary Examiner* — Eric J Kurilla
*Assistant Examiner* — Myles A Throop
(74) *Attorney, Agent, or Firm* — Alan G. Towner; Leech Tishman Fuscaldo & Lampl

(57) ABSTRACT

A baby crib comprises an upper frame, a lower frame and support members attached to the upper frame and the lower frame. The upper frame comprises a first part firmly attached to the support members and a second part. The second part is pivotally coupled with the support members to move reversibly from a first position to a second position to move said second part relative to said first part.

14 Claims, 6 Drawing Sheets

BABY CRIB

CROSS-REFERENCE TO RELATED APPLICATION

This application claims the benefit of European Patent Application Serial No. 16156569.2 filed Feb. 19, 2016, which is incorporated herein by reference.

TECHNICAL FIELD

The present invention relates to a baby crib.

In particular, the present invention relates to a baby crib to be positioned beside the parental bed.

BACKGROUND OF THE INVENTION

Baby cribs are well known in the art and are particularly used next to the bed of the mother or the person who cares for the baby at night.

An example of a known baby crib suitable for being used next to an adult bed is known from EP 2976973, which discloses a baby crib having a substantially rectangular shape, with a bottom having a mattress and with perimeter walls made of a flexible material. The bottom and the walls of the crib are supported by a frame composed of rod-like elements. In addition, the frame of the crib has support members that can be adjusted to increase and/or decrease the height of the crib, for adapting the height of the crib to the height of the bed.

One of the perimeter walls of greater longitudinal extent comprises a portion that can be detached from the adjacent walls, and overturned toward the exterior of the crib on the same wall by being folded around a line parallel to the plane of the bottom of the crib.

The line around which the wall portion is overturned is spaced from the plane of the bottom of the crib by a stationary wall portion. The wall portion can be detached from the adjacent walls by activating releasing means located on both sides of the rod-like element that supports the wall. The detached wall portion can then be overturned toward its own wall, forming an opening through which the person who cares for the baby may access the baby without rising from his/her bed.

Moreover, the crib comprises a safety rod-like element which extends in the stationary portion of the wall. The safety rod-like element comprises a pair of opposed sections which extend along the height of the stationary portion from the bottom of the crib, and one section that extends along the middle portion of the length of the stationary wall.

While the above structural arrangement provides advantages in addressing night time baby-care issues, it still suffers from certain drawbacks, including the problems arising when detaching the wall portion and overturning it on the side of the stationary portion.

In order to open the wall of the crib, the adult needs first to push the crib away from the adult bed to be able to fold the wall and attach the associated rod-like element to the bottom of the crib. Once the wall is overturned and fixed to the bottom of the crib, the adult needs to pull the crib closer to his bed to avoid that a gap is left therebetween.

In spite of all efforts, no one can exclude that a small gap is involuntary left between the crib and the adult bed once the wall portion has been overturned. Hence, a temporarily unattended baby may come out of the crib through the stationary portion of the wall and fall within the gap, as small as it is, between the crib and the side of the bed of the adult who is taking care of him/her.

Another drawback of the above mentioned crib is that, in order to detach and re-attach the wall portion, releasing and blocking means need to be activated while firmly holding the wall portion in place.

Thus, opening the crib wall becomes quite complex when managing the detaching and overturning procedures of the flexible wall. In fact, the detached wall can easily slip from the adult's hands and consequently fall towards the ground for gravity due to the weight of the rod-like element present inside the wall.

SUMMARY OF THE INVENTION

The object of the present invention is to provide a baby crib that overcomes the above mentioned drawbacks.

This object is achieved by a baby crib according to claim 1.

BRIEF DESCRIPTION OF THE DRAWINGS

The characteristics and advantages of the present invention will appear from the following detailed description of one practical embodiment, which is given as a non limiting example with reference to the annexed drawings, in which.

DETAILED DESCRIPTION

Figure 1:
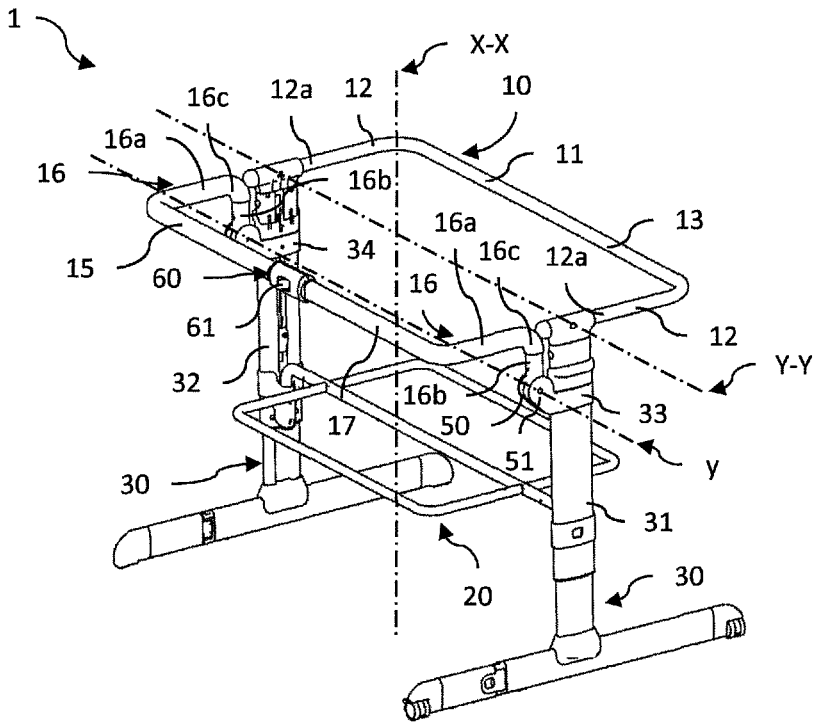
FIG. 1 shows a perspective view of a baby crib according to one embodiment of the present invention, in a first configuration.

With reference to the attached figures, a baby crib 1 according to one embodiment of the present invention is shown.

The baby crib 1 comprises an upper frame 10, a lower frame 20, support members 30 and, preferably, an enclosure 40.

The upper frame 10 is configured to be attached to an enclosure, such as the enclosure 40 that will be described hereinafter, and the lower frame 20 is configured to support a bottom wall of this enclosure.

The upper frame 10 is spaced apart from the lower frame 20 along a longitudinal direction X-X, corresponding to a vertical direction in the example shown in the figures.

The support members 30 are configured to rest on a ground surface. The support members 30 are attached to the upper frame 10 and the lower frame 20 and are spaced apart along a transverse direction Y-Y perpendicular to the longitudinal direction X-X. In the example shown in the figures, the transverse direction Y-Y corresponds to a horizontal direction.

Preferably, the support members 30 comprise two opposite support members 31, 32 attached at opposite sides of the upper frame 10 and the lower frame 20 and, as stated above, spaced apart along the transverse direction Y-Y.

According to the embodiment shown in the figures, each support member 31, 32 has a T shape where the transverse arm of the T shape forms a supporting element configured to rest on the ground surface while the longitudinal arm of T shape extends along the longitudinal direction X-X.

Preferably, the support member 31, 32 are configured to increase and/or decrease the height of the baby crib 1 from the ground, such that the baby crib 1, in particular the baby mattress M arranged in the enclosure 40, may be brought at the same height as the mattress M' of the bed against which the baby crib 1 is moved. However, when the crib is in use, it is most preferable to position the baby mattress M of the baby crib 1 in a lover position with respect to the mattress M' of the parent's bed against which the baby crib 1 is moved. Advantageously, a baby child resting in the baby crib 1 is not easily allowed to slip towards his parent's bed during a nap or in the night time (FIGS. from 11*a* to 11*d*).

According to the embodiment shown in the figures, the enclosure 40 has four side walls 41, 42, 43, 44 and a bottom wall 45.

The side walls 41, 42, 43, 44 have top portions 41*a*, 42*a*, 43*a*, 44*a* delimiting a top opening 46 of the enclosure 40. The side walls 41, 42, 43, 44 are made of flexible material, preferably textile material, and surround a space 47 configured to receive a baby.

Preferably, the bottom wall 45 is also made of flexible material. The bottom wall 45 receives a baby mattress M (not shown in the figures).

In this embodiment, the upper frame 10 is attached to the top portions 41*a*, 42*a*, 43*a*, 44*a* of the side walls 41, 42, 43, 44 while the lower frame 20 supports the bottom wall 45.

The upper frame 10 comprises a first part 11 and a second part 15.

Figure 2:
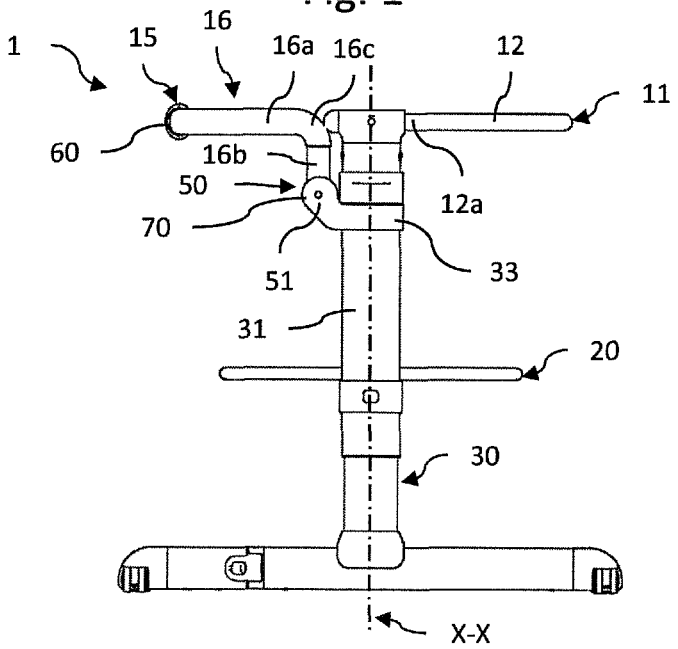
FIGS. 2-4 show different plan views of the baby crib of FIG. 1.
Figure 3:
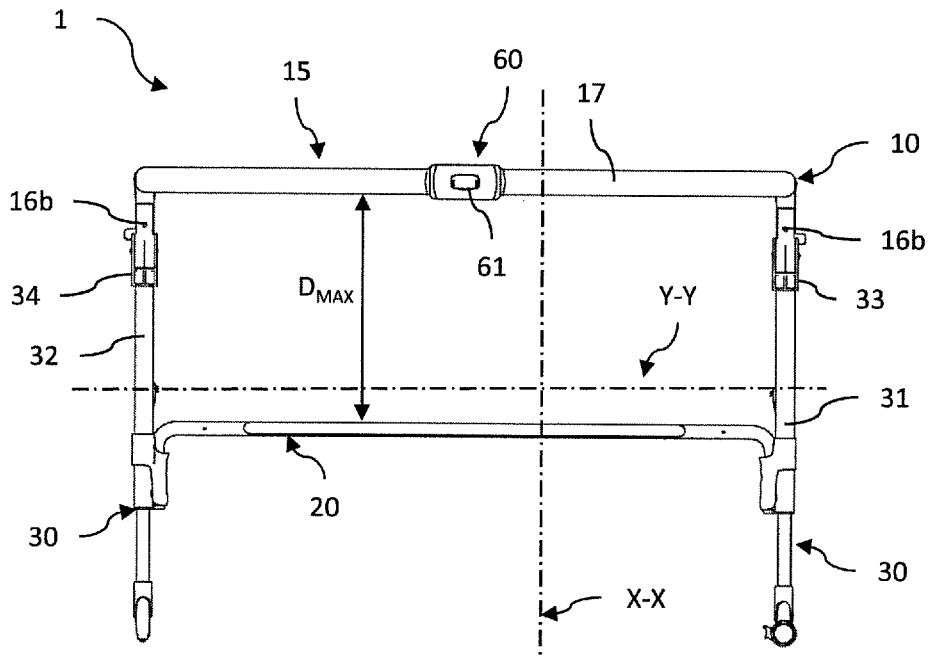
Figure 4:
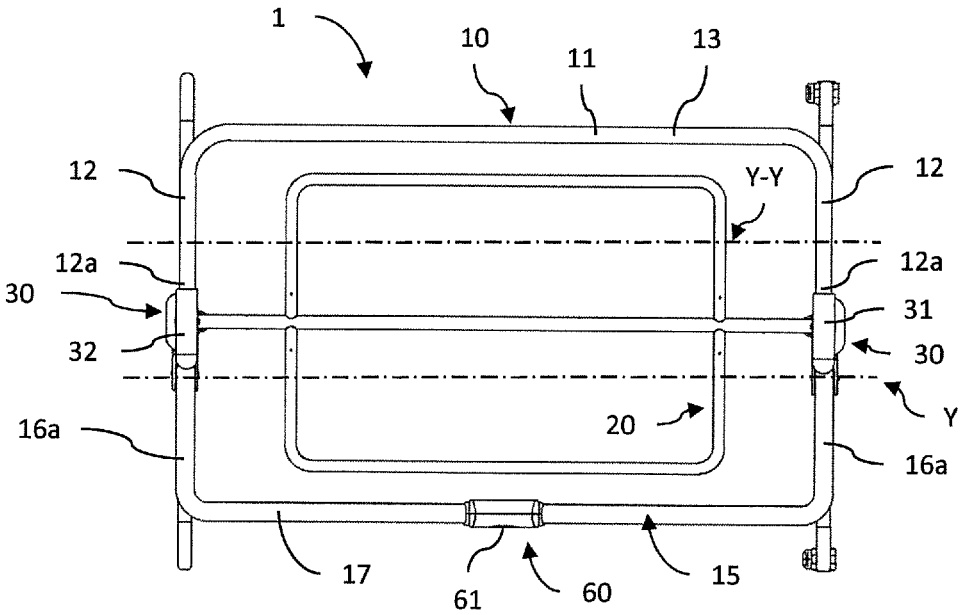
Figure 5:
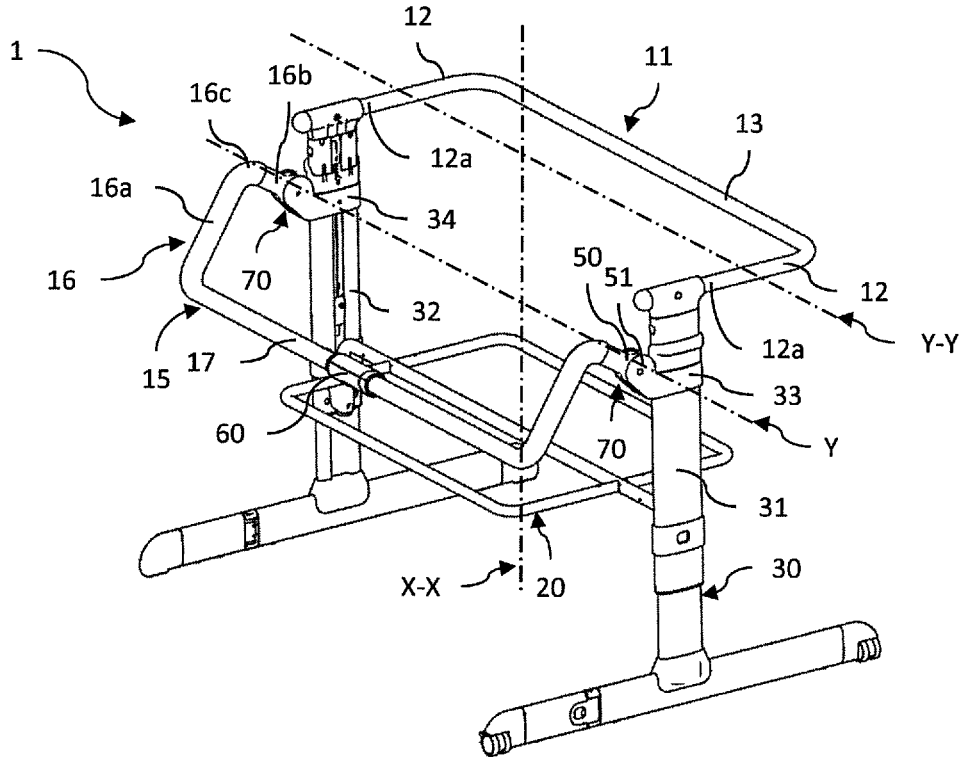
FIG. 5 shows a perspective view of a baby crib according to one embodiment of the present invention, in a second configuration.
Figure 6:
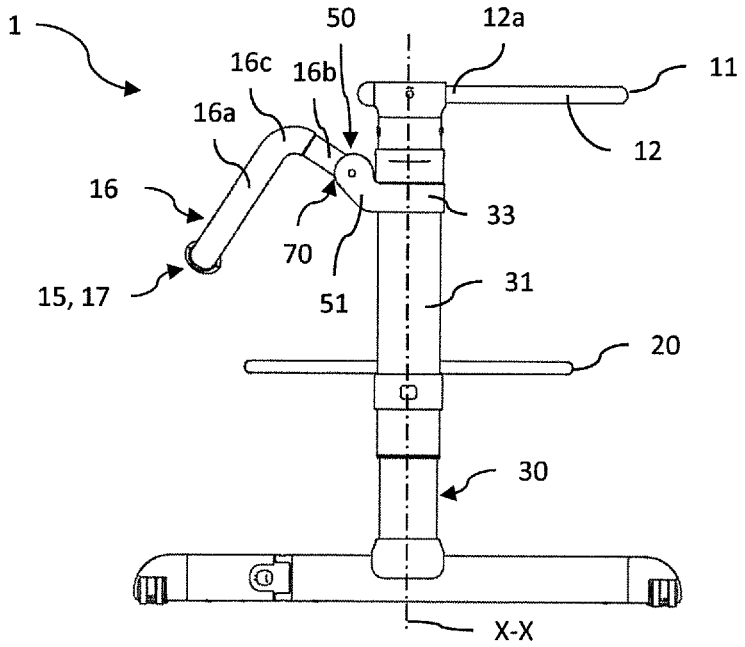
FIGS. 6-8 show different plan views of the baby crib of FIG. 5.
Figure 7:
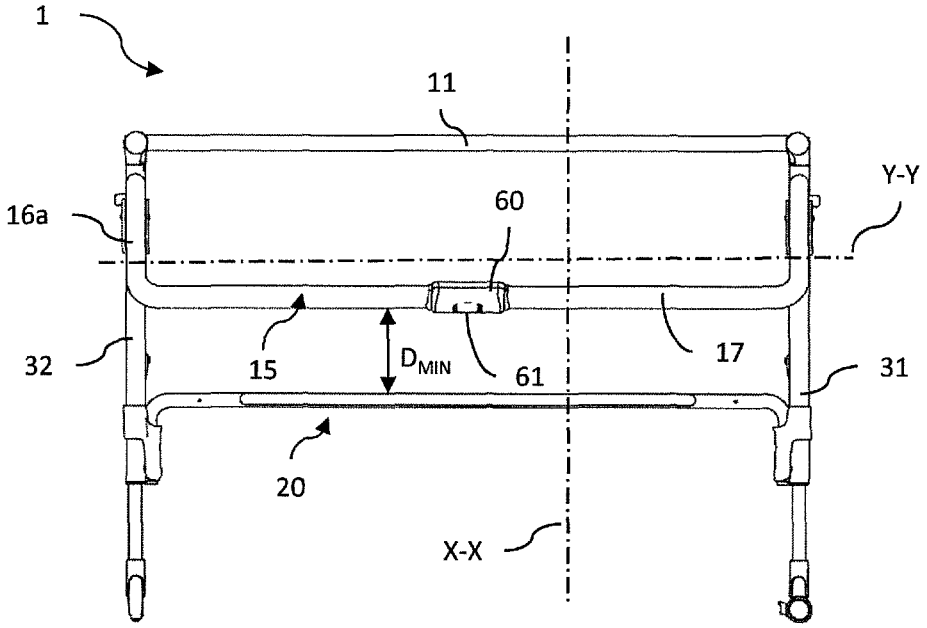
Figure 8:
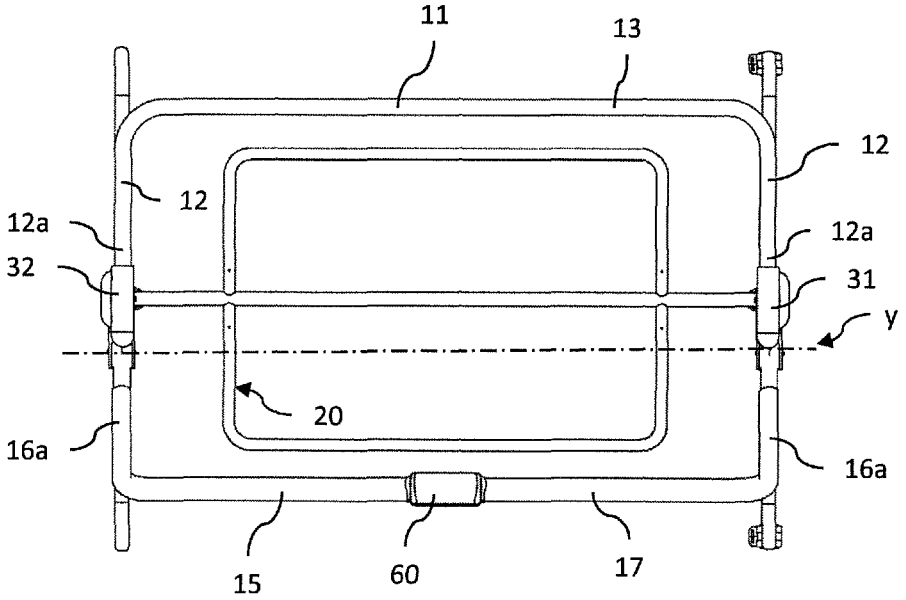
Figure 9:
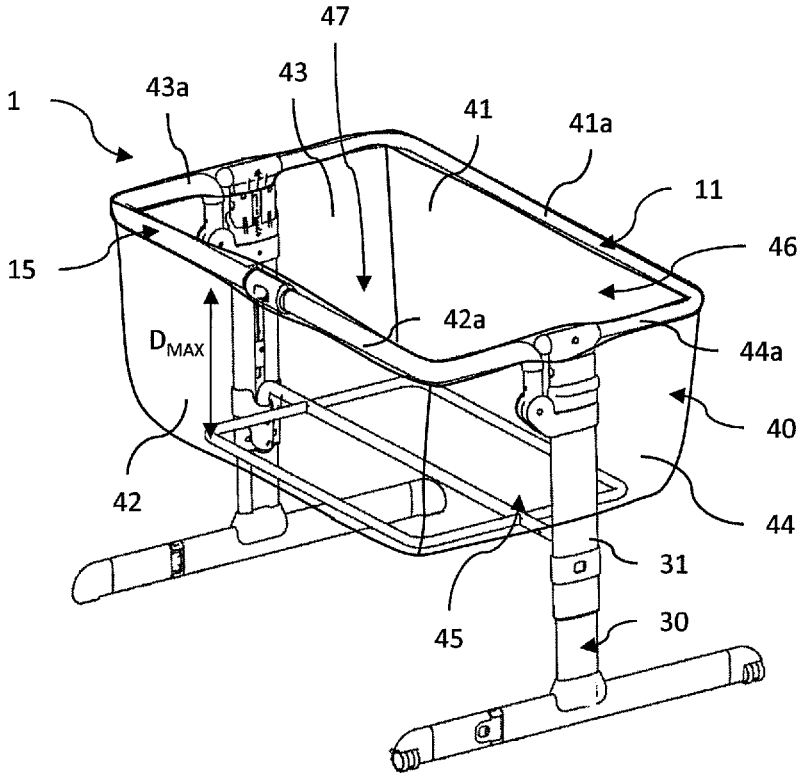
FIG. 9 shows a perspective view of the baby crib of FIG. 1 with an enclosure.
Figure 10:
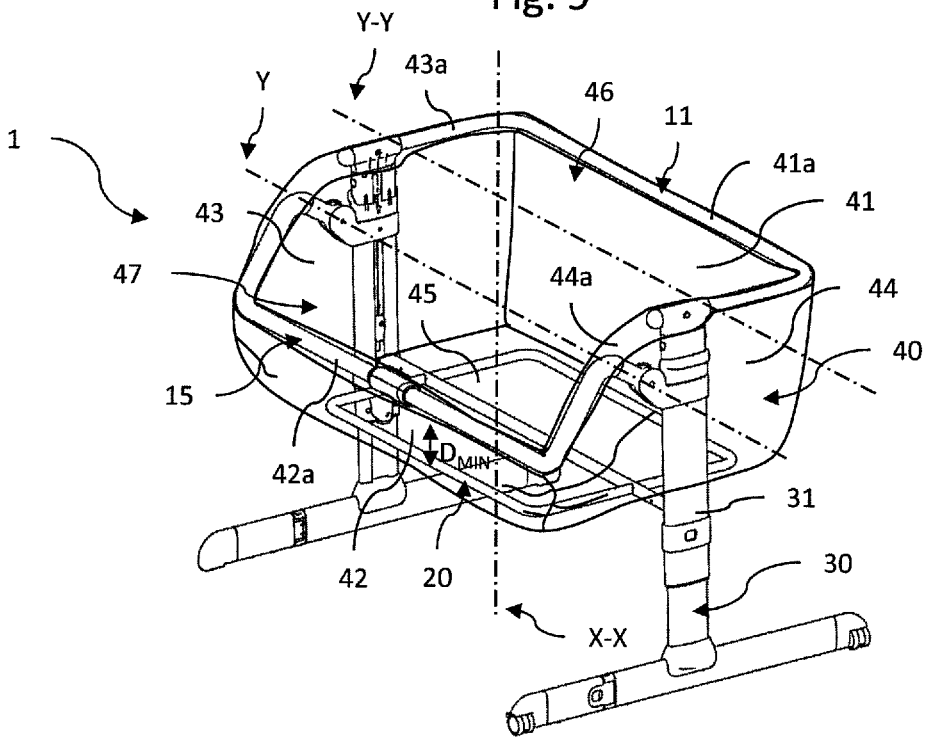
FIG. 10 shows a perspective view of the baby crib of FIG. 5 with an enclosure.

The first part 11 is firmly attached to the support members 30 whereas the second part 15 is pivotally coupled with the support members 30 to move reversibly from a first position (FIGS. 1-4) to a second position (FIGS. 5-8) to move the second part 15 relative to the first part 11.

In particular, the second part 15 is pivotally coupled with the support members 30 to move reversibly from a first higher position to a second lower position.

Preferably, in the first position, the first part 11 and the second part 15 form a substantially rectangular shape of the upper fame 10.

The movement of the second part 15 from the first position to the second position allows an easier access to the space 47 of the baby crib 1 and a better parental control also when the baby crib 1 is positioned beside the bed of parents so that they may take care of the baby by simply rotating the second part 15 without need to push the baby crib 1 away from the bed and pull closer to the bed for moving the second part 15 in the second position.

Preferably, the second part 15 is configured to move from the first position to the second position to lower the second part 15 relative to the first part 11.

More preferably, the second part 15 is configured to move from the first position to the second position to move the second part towards the lower frame 20.

In particular, the first position and the second position define respectively a maximum distance Dmax and a minimum distance Dmin, measured along the longitudinal direction X-X, between the second part and the lower frame.

The second part 15 is pivotally coupled with the support members 30 around a pivot axis Y. Preferably, the pivot axis Y extends along the transverse direction Y-Y and is offset relative to the support members 30. In other words, the pivot axis Y is shifted with respect to the support members 30. Thereby, the pivot axis Y does not pass through the support members 30.

Preferably, the pivot axis Y is arranged in a longitudinal position between the first part 11 and the lower frame 20.

In the first position, the second part 15 defines a first border laying on a plane perpendicular to the longitudinal direction X-X. In the second position, the projection of the second part 15 on that plane defines a second border corresponding to the first border or arranged within the first border.

According to the embodiment shown in the figures, the first part 11 and the second part 15 comprise a rod-like element, referred to as first rod-like element 11 and second rod-like element 15.

The first rod-like element 11 is U shaped and comprises two opposed sections 12 coupled at opposite sides to the supporting members 31, 32 and an elongated section 13 connecting the two opposed sections 12.

The second rod-like element 15 is U shaped and comprises two opposed sections 16 coupled at opposite sides to the supporting members 31, 32 and an elongated section 17 connecting the two opposed sections 16.

According to one embodiment, the opposed sections 12 lay on a same plane with the elongated section 13, while the opposed sections 16 comprise first portions 16*a* laying on a same plane with the elongated section 17 and second portions 16*b* extending perpendicularly to the first portions 16*a* and joined with the first portions 16*a* through curved portions 16*c*.

According to one embodiment, the support members 31, 32 are provided with seats receiving and retaining end portions 12*a* of the opposed sections 12, opposite to the elongated section 13 so that the first part 11 is firmly attached to the support members 31, 32.

According to one embodiment, a coupling member 33, 34 is firmly attached to a corresponding supporting member 31, 32 and is pivotally coupled at opposite side of the second part 15 trough a corresponding pin arranged in a seat formed in the relative coupling member.

According to one embodiment, the second part 15 comprises locking members 50 to lock the second part 15 relative to the support members 30 in the first position and releasing members 60 are provided to release the locking members 50 to unlock the second part 15 from the support members 30 in the first position and allow the second part to move into the second position.

The locking members 50 are configured to cooperate with corresponding locking members 51 associated with the support members 30.

Preferably, the releasing members 60 are provided on the second part 15, more preferably in a middle portion of the elongated section 17 of the second part. For example, the releasing members 60 comprise a button 61 manually operable by a user and a releasing device (not shown) connecting the button 61 to the locking members 50 to move the locking member 50 from a locking position to an unlocking position to unlock the second part 15 relative to the first part 11.

Preferably stop members 70 are provided to stop the second part 15 in the second position. According to one embodiment, the stop members 70 comprise a stop surface formed on the opposed sections 16 of the second part 15 and configured to abut against a stop surface formed on the coupling members 33, 34. The stop surface of the second part 15 may be formed in a pin or hook.

Preferably, the locking members 50 activate as the second part 15 reaches the first position when moving from the second position to the first position.

According to the embodiment shown in the figures, the first part 11 is attached to the first top portion 41*a* of the first side wall 41 of the enclosure 40. The second part 15 is attached to the second top portion 42*a* of the second side wall 42 of the enclosure 40. In the first position, a first distance D1 is defined as measure along the longitudinal direction X-X between the second top portion 42*a* and the bottom wall 45. In the second position, a second distance D2 is defined as measure along the longitudinal direction X-X between the second top portion 42*a* and the bottom wall 45. In particular, the second distance D2 is smaller than the first distance D1. Thereby, as the second part 15 pivots around the pivot axis Y from the first position to the second position, the second side wall 42 collapses.

Figure 11A:
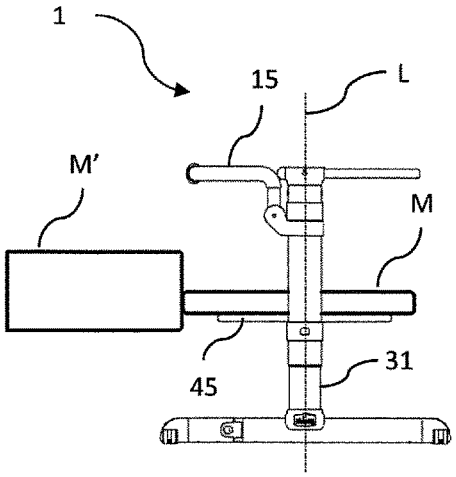
FIGS. 11*a*, 11*b*, 11*c* and 11*d* show side views of several positions of the baby crib according to a preferred embodiment.
Figure 11B:
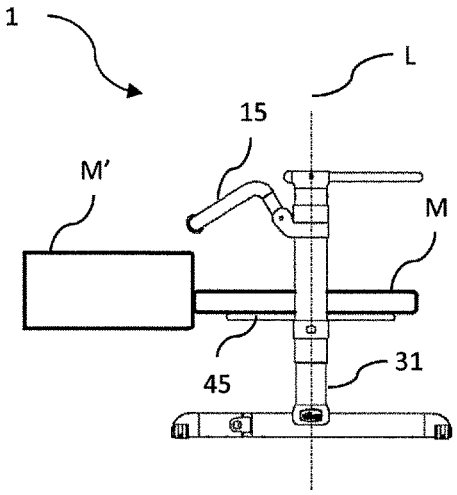
Figure 11C:
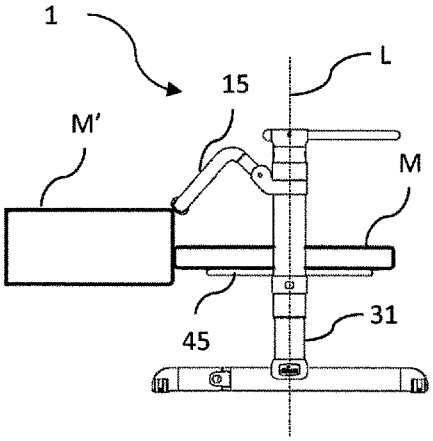
Figure 11D:
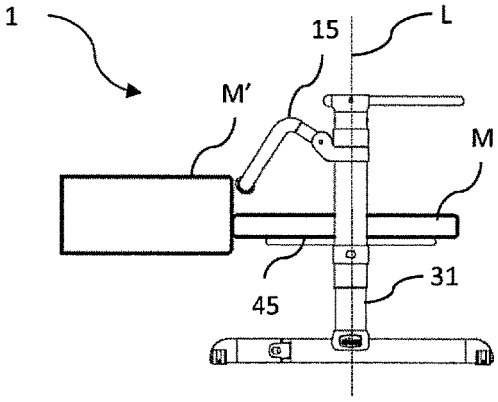

According to a preferred embodiment, the bottom wall 45 of the enclosure 40 is configured to receive a baby mattress M. Preferably, the baby crib 1 comprises a baby mattress M received in the bottom wall 45. According to this embodiment, the support members 30 comprise two opposite support members 31, 32 attached at opposite sides of the upper frame 10 and the lower frame 20. Each support member 31, 32 has a T shape, wherein the transverse arm of the T shape are configured to rest on the ground surface, while the longitudinal arm of T shape extends along the longitudinal direction X-X. Each longitudinal arm of the T shaped support members 31, 32 has a central line L of symmetry laying along the longitudinal direction X-X. The upper frame 10 is attached to the top portions 41*a*, 42*a*, 43*a*, 44*a* of the side walls 41, 42, 43, 44 of the enclosure 40 to hold the baby mattress M in place in the bottom portion 45. More preferably, the upper frame 10 is attached to the top portions 41*a*, 42*a*, 43*a*, 44*a* of the side walls 41, 42, 43, 44 to hold the baby mattress M in a horizontal position in which the baby mattress M is so arranged: a) perpendicularly with respect to the longitudinal direction X-X, and b) asymmetrically with respect to the central line L of the longitudinal arms of the T shaped support members 31, 32, in such a way the baby mattress M protrudes more from the side of the baby crib 1 having the second part 15 (FIGS. 11*a*, 11*b*, 11*c* and 11*d*, where the enclosure 40 is not shown to facilitate intelligibility of figures). It shall be noted that, when the baby crib 1 is in use, the side of the baby mattress M located on the side of the baby crib 1 having the second part 15 enters into contact with a side of the parent's mattress M'. Of course, the contact between the baby mattress M and the parent's mattress M' is not direct, but it occurs through contact with the side of the enclosure 40 enveloping the baby mattress M. Advantageously, as can be seen in figures from 11*a* to 11*d*, the protrusion of the baby mattress M on the side of the baby crib 1 having the second part 15 allows free movement of such second part between the first and second position. In fact, due to a slight asymmetrical disposition of the baby mattress M, e.g., shifted by few centimeters towards the side of the baby crib 1 having the second part 15, avoids interference between the second part 15 and the parent's mattress M' when the second part 15 pivots between the first and second position (FIGS. from 11*a* to 11*d*).

The invention claimed is:

1. Baby crib comprising:

an enclosure having side walls, including at least a first side wall and a second side wall, made of a flexible material and defining a space configured to receive a baby, the enclosure also having a bottom wall made of a flexible material, said side walls having top portions delimiting a top opening of the enclosure;

an upper frame configured to be attached to said enclosure, a lower frame configured to support said bottom wall, said upper frame being spaced apart from said lower frame along a longitudinal direction, support members attached to said upper frame and said lower frame, said support members being configured to rest on a ground surface and being spaced apart along a transverse direction perpendicular to said longitudinal direction, wherein said upper frame comprises a first part firmly attached to said support members and a second part, said first part being attached to a first top portion of the first side wall of the enclosure, said second part being attached to a second top portion of the second side wall of the enclosure, said second part is pivotally coupled with said support members around a pivot axis to move reversibly from a first position to a second position to move said second part relative to said first part, said pivot axis being arranged in a longitudinal position between the first part and the lower frame, and said second part is U shaped and comprises two opposed sections coupled at opposite sides to the support members and an elongated section connecting the two opposed sections, said opposed sections comprising first portions laying on a same plane with the elongated section and second portions extending perpendicularly to the first portions and being joined with the first portions.

2. Baby crib according to claim 1, wherein said second part is configured to move from said first position to said second position to lower said second part relative to said first part.

3. Baby crib according to claim 1, wherein said second part is configured to move from said first position to said second position to move said second part towards said lower frame.

4. Baby crib according to claim 1, wherein said first position and second position define respectively a maximum distance and a minimum distance, measured along said longitudinal direction, between said second part and said lower frame.

5. Baby crib according to claim 1, wherein said pivot axis extends along said transverse direction and is offset relative to said support members.

6. Baby crib according to claim 1, wherein:

in the first position, the second part defines a first border laying on a plane perpendicular to the longitudinal direction, in the second position, a projection of the second part on said plane defines a second border corresponding to or arranged within the first border.

7. Baby crib according to claim 1, wherein:

each of said first part and second part comprises a rod-like element, said rod-like element is U-shaped and comprises two opposed section coupled at opposite sides to the support members and an elongated section joining the two opposed sections.

8. Baby crib according to claim 1, wherein:

said support members comprise two opposite support members attached at opposite sides of the upper frame and the lower frame, each support member having a T shape, wherein a transverse arm of the T shape is configured to rest on the ground surface while a longitudinal arm of the T shape extends along the longitudinal direction, said bottom wall of said enclosure is configured to receive a baby mattress, said upper frame is attached to said top portions of said side walls of the enclosure to hold said baby mattress in a horizontal position in which the baby mattress is arranged perpendicularly with respect to the longitudinal direction, and asymmetrically with respect to the central line of said longitudinal arms of the T shaped support members in such a way that the baby mattress protrudes more from the side of the baby crib having the second part.

9. Baby crib according to claim 1, wherein:

in the first position, a first distance is defined and measured along the longitudinal direction between the second top portion and the bottom wall, in the second position, a second distance is defined and measured along the longitudinal direction between the second top portion and the bottom wall, said second distance is smaller than said first distance.

10. Baby crib according to claim 1, wherein:

as the second part pivots around the pivot axis from said first position to said second position, said second side wall collapses.

11. Baby crib according to claim 1, wherein said second portions of the opposed sections connect the first portions to the pivot axis.

12. Baby crib according to claim 1, wherein the pivot axis is arranged below the plane of the first portions and the elongated section.

13. Baby crib comprising:

an enclosure having side walls, including at least a first side wall and a second side wall, made of a flexible material and defining a space configured to receive a baby, the enclosure also having a bottom wall made of a flexible material and being configured to receive a baby mattress, said side walls having top portions delimiting a top opening of the enclosure;

an upper frame configured to be attached to said enclosure, a lower frame configured to support said bottom wall, said upper frame being spaced apart from said lower frame along a longitudinal direction, two opposite support members attached at opposite sides of the upper frame and at opposite sides of the lower frame, each support member having a T shape, wherein a transverse arm of the T shape is configured to rest on the ground surface while a longitudinal arm of the T shape extends along the longitudinal direction, said support members being spaced apart along a transverse direction perpendicular to said longitudinal direction, wherein said upper frame comprises a first part firmly attached to said support members and a second part, said first part being attached to a first top portion of the first side wall of the enclosure, said second part being attached to a second top portion of the second side wall of the enclosure, said second part is pivotally coupled with said support members around a pivot axis, to move reversibly from a first position to a second position to move said second part relative to said first part, said pivot axis extending along said transverse direction, offset relative to said support members, and being arranged in a longitudinal position between the first part and the lower frame, and said second part is U shaped and comprises two opposed sections coupled at opposite sides to the support members and an elongated section connecting the two opposed sections, said opposed sections comprising first portions, laying on a same plane with the elongated section, and second portions connecting the first portions to the pivot axis, the second portions extending perpendicularly to the first portions.

14. Baby crib comprising:

an enclosure having side walls, including at least a first side wall and a second side wall, made of a flexible material and defining a space configured to receive a baby, the enclosure also having a bottom wall made of a flexible material, said side walls having top portions delimiting a top opening of the enclosure;

an upper frame configured to be attached to said enclosure, a lower frame configured to support said bottom wall, said upper frame being spaced apart from said lower frame along a longitudinal direction, two opposite support members attached at opposite sides of the upper frame and at opposite sides of the lower frame, each support member having a T shape, wherein a transverse arm of the T shape is configured to rest on the ground surface while a longitudinal arm of the T shape extends along the longitudinal direction, said support members being spaced apart along a transverse direction perpendicular to said longitudinal direction, wherein said upper frame comprises a first part firmly attached to said support members and a second part, said first part being attached to a first top portion of the first side wall of the enclosure, said second part being attached to a second top portion of the second side wall of the enclosure, said second part is pivotally coupled with said support members around a pivot axis, to move reversibly from a first position to a second position to move said second part relative to said first part, said pivot axis being arranged in a longitudinal position between the first part and the lower frame, said second part is U shaped and comprises two opposed sections coupled at opposite sides to the support members and an elongated section connecting the two opposed sections, said opposed sections comprising first portions laying on a same plane with the elongated section and second portions extending perpendicularly to the first portions and being joined with the first portions, and said upper frame is attached to said top portions of said side walls of the enclosure to hold a baby mattress in a horizontal position in which the baby mattress is arranged perpendicularly with respect to the longitudinal direction, and the second part in the first position protruding more than the first part with respect to the central line of said longitudinal arms of the T shaped support members, such that the baby mattress is held asymmetrically with respect to the central line of said longitudinal arms of the T shaped support members in such a way that the baby mattress protrudes more from the side of the baby crib having the second part.

* * * * *